US006722645B2

(12) United States Patent
Lorenzi

(10) Patent No.: US 6,722,645 B2
(45) Date of Patent: Apr. 20, 2004

(54) AUTOMATIC MACHINE FOR THE CONTINUOUS BINDING OF BOOKS AND BROCHURES

(75) Inventor: Mario Lorenzi, Villafranca (IT)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/292,286

(22) Filed: Nov. 12, 2002

(65) Prior Publication Data

US 2003/0072638 A1 Apr. 17, 2003

Related U.S. Application Data

(63) Continuation of application No. PCT/IT01/00224, filed on May 9, 2001.

(30) Foreign Application Priority Data

May 12, 2000 (IT) ..... PD2000A0123

(51) Int. Cl.[7] ..... B42C 5/00

(52) U.S. Cl. ..... 270/58.07; 270/58.07; 412/8; 412/16; 412/37; 118/238; 118/241; 118/247

(58) Field of Search ..... 270/58.07, 58.08; 271/210; 118/238, 241, 244; 412/8, 16, 37

(56) References Cited

U.S. PATENT DOCUMENTS

| | | | | | |
|---|---|---|---|---|---|
| 2,126,138 | A | | 8/1938 | Riese | |
| 2,605,739 | A | * | 8/1952 | De Florez | 412/37 |
| 3,092,382 | A | * | 6/1963 | Busch et al. | 271/210 |
| 3,669,246 | A | * | 6/1972 | Risi | 198/803.7 |
| 3,866,568 | A | | 2/1975 | Minami | |
| 4,014,287 | A | * | 3/1977 | Green | 118/696 |
| 4,231,466 | A | * | 11/1980 | Rathert | 198/803.7 |
| 4,408,780 | A | | 10/1983 | Detterman et al. | |
| 4,484,850 | A | * | 11/1984 | Shimizu | 412/11 |
| 4,556,353 | A | * | 12/1985 | Ehlermann | 412/5 |
| 4,904,138 | A | * | 2/1990 | Champeaux et al. | 412/8 |
| 5,088,973 | A | | 2/1992 | Bruce et al. | |
| 5,176,371 | A | | 1/1993 | Rau et al. | |
| 5,318,398 | A | * | 6/1994 | Kojima | 412/18 |
| 5,605,575 | A | * | 2/1997 | Anderson | 118/679 |
| 5,702,220 | A | | 12/1997 | Combs | |
| 6,193,458 | B1 | * | 2/2001 | Marsh | 412/1 |
| 6,206,358 | B1 | * | 3/2001 | Yamaguchi et al. | 270/52.02 |
| 6,447,230 | B1 | * | 9/2002 | Takai et al. | 412/14 |

* cited by examiner

*Primary Examiner*—Patrick Mackey
(74) *Attorney, Agent, or Firm*—Laurence A. Greenberg; Werner H. Stemer; Ralph E. Locher

(57) ABSTRACT

A machine for the continuous binding of books and booklets, includes clamps mounted on a chain for the transport of groups of sheets to be bound along various stations. Each clamp is provided with a manual opening mechanism. A sheet levelling device includes two parallel horizontal plates joined by connecting elements, the lower of which is permanently fixed to the machine, while the upper of which supports a horizontal levelling table provided with vibrators. Trimming millers are also provided. A glue spreading unit with rollers and blades includes two complementary parts. A first one of the parts is hinged to a structure of the machine, can be rotated laterally and supports a second interchangeable one of the parts that in turn supports a glue tank, the rollers and the blades.

8 Claims, 3 Drawing Sheets

AUTOMATIC MACHINE FOR THE CONTINUOUS BINDING OF BOOKS AND BROCHURES

CROSS-REFERENCE TO RELATED APPLICATION

This application is a continuation of copending International Application No. PCT/IT01/00224, filed May 9, 2001, which designated the United States and which was published in English.

BACKGROUND OF THE INVENTION

Field of the Invention

The invention relates to the field of bookbinding machines and machines for the gathering of books and volumes. In particular, it relates to an improved automatic machine for the continuous binding of books and brochures or booklets.

Automatic machines for the binding of groups of sheets are widely known. Those machines include one or more pneumatic clamps in which the sheets to be bound are inserted and which transport the group of sheets along an entire binding sequence. They also include a vibrating plane that aligns and a miller which trims the group of sheets to be bound, glue rollers and blades that spread the glue on the sheets, a casing-in device that positions each cover on the folding machine and a cover-pressing mechanism which presses the cover on to the group of sheets.

The bookbinding machines which are constructed as described above present a series of characteristics that slow down production and/or require the performance of manual operations.

The pneumatic clamp that transports the group of sheets is opened and closed mechanically and/or pneumatically by mechanisms of the machine, depending on the position of the sheets along their route. In the case of jamming of the mechanisms, or if the sheets must be removed for any other reason, it is necessary to force the opening of the clamp manually as well as to move the entire chain that transports the clamp forward or backward, with the risk of being injured and/or of making pieces of sheets or covers fall into the mechanisms of the machine.

The sheet levelling tables are positioned on various cams, in such a way as to permit their vertical adjustment depending on the edge that must be successively trimmed by the miller or millers. That system with cams for the adjustment of the levelling table does not ensure a correct horizontal adjustment of the table itself, and consequently as a result the sheets tend to be inclined with respect to the millers as well as to the cover that is successively applied.

The glue rollers and blades are partially immersed in a glue tank. Since different types of glue are used, it must be possible to remove the tank, the rollers and the blades either to change or to clean them. At present the tank, rollers and blades are positioned on a trolley in order to constitute a single unit. Therefore, a trolley is provided with rollers and blades for any type of glue, which represents a considerable encumbrance and a considerable weight to be handled.

SUMMARY OF THE INVENTION

It is accordingly an object of the invention to provide an improved automatic machine for the continuous binding of books and brochures, which overcomes the above-mentioned disadvantages of the heretofore-known machines of this general type.

With the foregoing and other objects in view there is provided, in accordance with the invention, an automatic machine for the continuous binding of books and booklets, comprising a sheet leveling device, trimming millers, an innovative glue spreading unit having rollers and blades, a chain, a series of innovative pneumatic clamps mounted on the chain for transporting groups of sheets to be bound along various stations, mechanisms controlling opening and closing of the clamps in various sections of a binding process, and a cover-pressing mechanism. Each of the clamps has a manual opening mechanism independent of the mechanisms controlling the opening and closing of the clamps.

The pneumatic clamps are adjustable and can hold the groups of sheets independently of their volume, up to a given maximum thickness. These pneumatic clamps are mounted on a chain that is generally ring-shaped and runs along the stations of the bookbinding process until the clamps return to a starting area where the groups of sheets are loaded.

The pneumatic clamps serve the function of transporting each group of sheets along the various processing stations and of preventing the individual sheets from moving relative to one another.

These pneumatic clamps include two vertical walls between which the groups of sheets are positioned. The opening and closing of the two parts of the clamp takes place through the use of mechanisms that are present partly on the clamp and partly on the fixed structure of the machine. The clamp is automatically opened, closed, or held in one of these two positions, depending on which section of the chain is being covered.

A second mechanism provided with an elastic element and an operating lever is applied to the clamp opening and closing mechanism. The second mechanism allows the two parts of the clamp to be opened at any given moment. The elastic element provides for keeping the two parts in the position controlled by the clamp opening and closing mechanisms of the new machine, while the lever counteracts the action of the elastic element and opens the two parts of the clamp as much as necessary to permit the release of the group of sheets held between them.

The second clamp opening mechanism allows an operator to remove the sheets that may be positioned incorrectly or jammed in the clamp.

In accordance with another feature of the invention, the sheet levelling device includes two horizontal plates disposed parallel to each other. The lower of the plates is permanently fixed to the machine, while the upper one supports a horizontal levelling table provided with vibrators.

The two horizontal parallel plates are joined through the use of connecting elements. One of these connecting elements is provided with a protrusion positioned beside the lower plate and provided with a round hole. An eccentric screw hinged to the lower horizontal plate is inserted in the hole. The rotation of the eccentric screw causes rotation of the corresponding connection element and consequently lifting or lowering of the upper horizontal plate. Since the two plates are joined by the connecting elements, the lifting or lowering of one of them causes the corresponding lifting or lowering of the others, and consequently the upper horizontal plate is lifted or lowered while remaining parallel to itself.

As a consequence of the above, the horizontal levelling table is also lifted and lowered while remaining parallel to itself, always in a horizontal position.

In this way, the sheets levelled by the levelling device mentioned above are always positioned correctly for the successive millers that will operate according to the thickness to be cut.

In accordance with a concomitant feature of the invention, the glue spreading unit includes two complementary parts, one of which is applied to the structure of the machine, while the other is interchangeable.

The part of the glue spreading unit applied to the structure of the machine includes a table or support hinged to the structure, in such a way as to rotate from an operating position beside the new bookbinding machine to a maintenance position in which the table or support is facing away from the bookbinding machine.

A mechanical coupling for the transmission of motion is provided on the structure of the bookbinding machine and on the rotary table or support. When the rotary table or support is placed in the operating position beside the structure of the machine, the mechanical coupling for the transmission of motion provides for transmitting motion to the components of the glue spreading unit. Other connections without the transmission of motion provide for centering the table or support in the correct position on the bookbinding machine.

The interchangeable part of the glue spreading unit substantially includes a tank provided with glue rollers and blades. The rollers partially protrude from an upper edge of the tank, since they take the glue present inside the tank with their lower side and spread it on the sheets with their upper side. The blades provide for adjusting the quantity of glue that the rollers deposit on the sheets.

The second interchangeable part is connected to the first rotary part through the use of either hooks or joints that ensure its correct position and of mechanical couplings which transmit motion from the bookbinding machine to the rollers.

Through rotation of the glue spreading unit it is possible to comfortably remove or service the assembly of the tank, the rollers and the blades and it is also possible to replace the assembly of the tank, the rollers and the blades specifically used for one type of glue with a different assembly specifically used for another type of glue and if necessary provided with heating elements.

Even the simple cleaning of the tank, rollers and blades is much easier, since they are light and not cumbersome.

Other features which are considered as characteristic for the invention are set forth in the appended claims.

Although the invention is illustrated and described herein as embodied in an improved automatic machine for the continuous binding of books and brochures, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
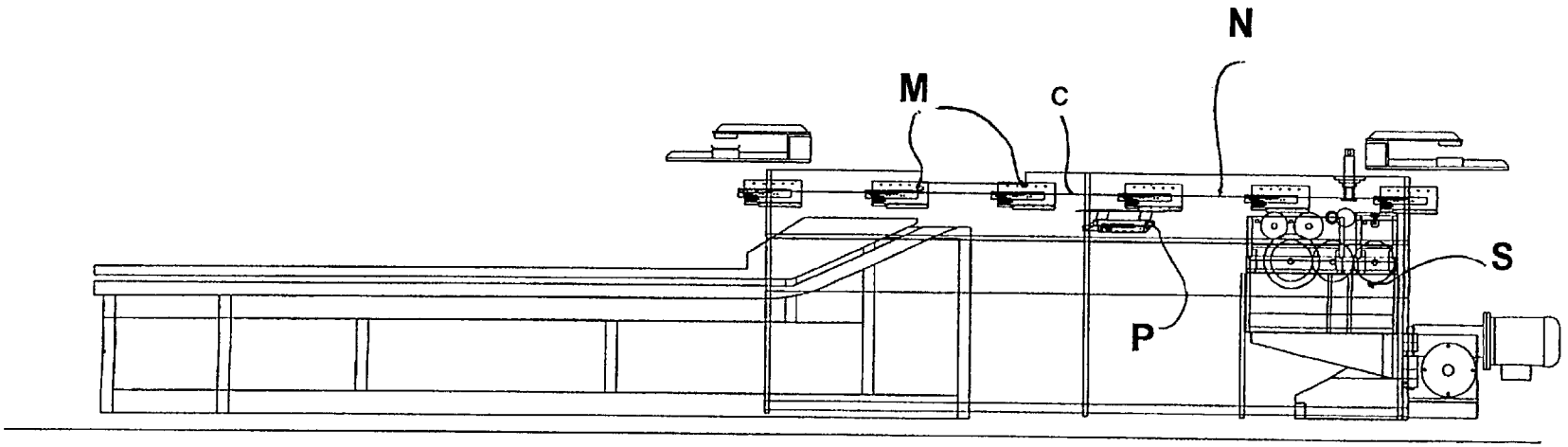
FIG. 1 is a diagrammatic, side-elevational view of a new bookbinding machine.

Referring now to the figures of the drawings in detail and first, particularly, to FIG. 1 thereof, there is seen a bookbinding machine N having a chain C with clamps M, a sheet levelling device P and a glue spreading unit S.

Figure 2A:
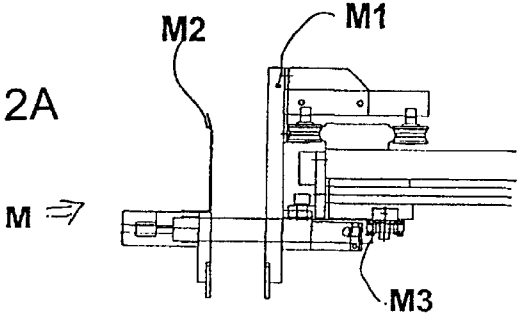
FIGS. 2A, 2B and 2C are respective front-elevational, side-elevational and plan views of a clamp.
Figure 2B:
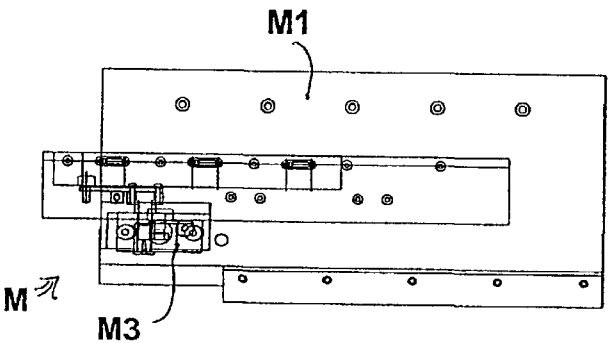
Figure 2C:
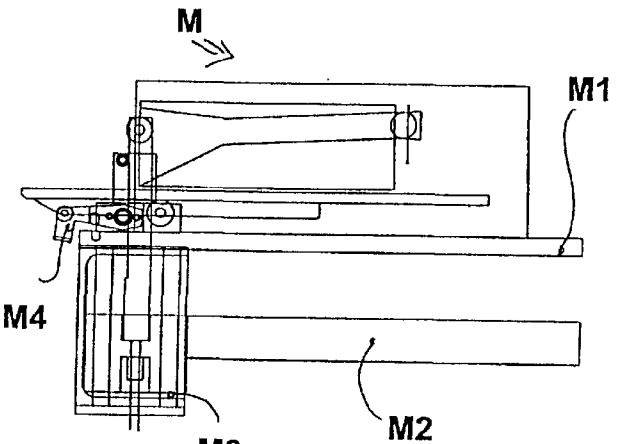

FIGS. 2A, 2B and 2C show a clamp M having two vertical walls M1, M2, namely a first wall M1 transported by the chain C and a second wall M2 connected to the first wall M1 by an opening and closing mechanism M3. An easy-to-reach lever M4 makes it possible to release the second wall M2 from the opening and closing mechanism M3.

Figure 3A:
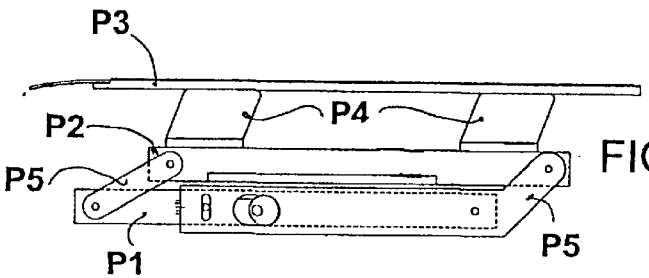
FIGS. 3A and 3B are side-elevational views showing the sheet levelling device.
Figure 3B:
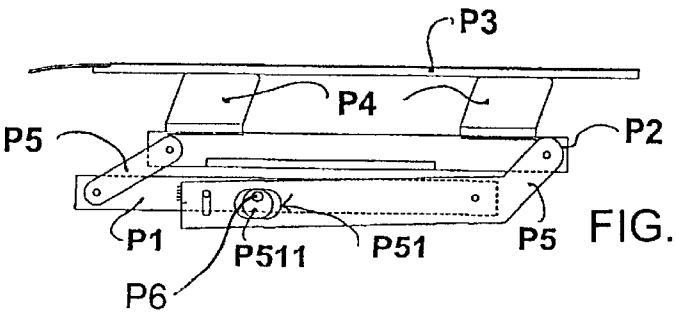

FIGS. 3A and 3B illustrate that the sheet levelling device P has two parallel horizontal plates P1, P2, namely a lower plate P1 permanently fixed to the machine and an upper plate P2 supporting a horizontal levelling table P3 equipped with vibrators P4. The two parallel horizontal plates P1, P2 are joined by connecting elements P5, one of which is provided with a side protrusion P51 having a hole P511. An eccentric screw P6 inserted in the hole P511 makes it possible to adjust an inclination of the connecting element P5 and consequently a vertical position of the second horizontal plate P2.

Figure 4A:
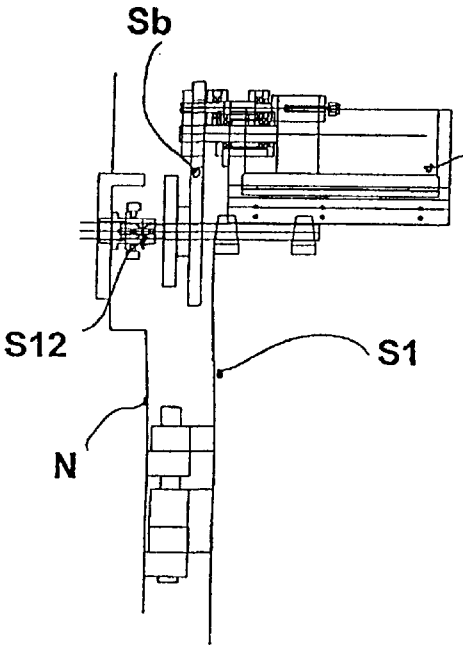
FIG. 4A is a front-elevational view and FIGS. 4B and 4C are respective plan views of the glue spreading unit in closed and open positions.
Figure 4B:
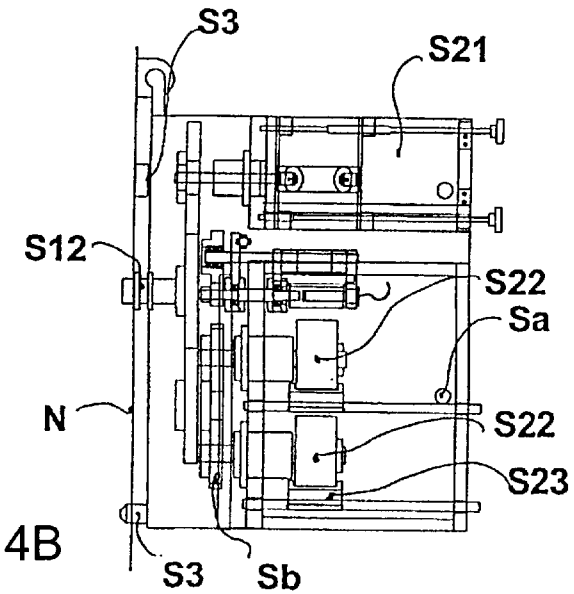
Figure 4C:
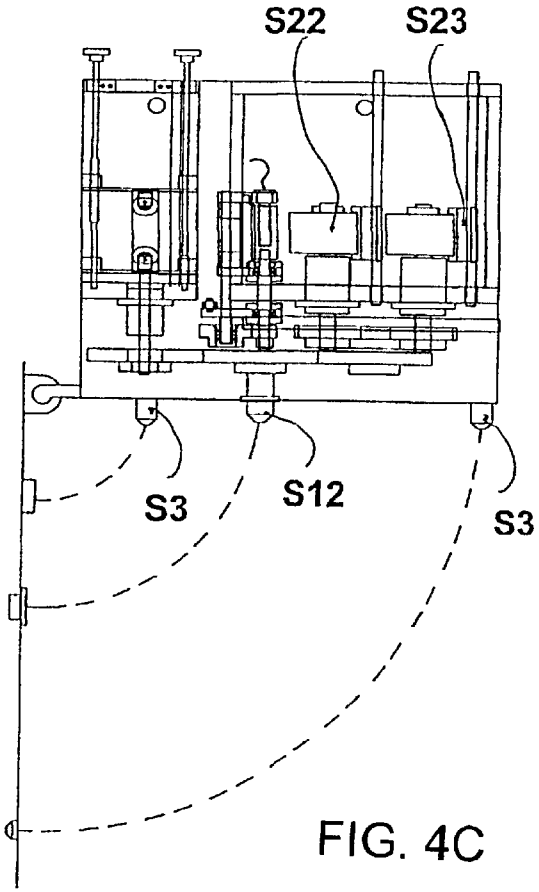

With reference to FIGS. 4A, 4B and 4C, it is seen that the glue spreading unit S has two complementary parts. FIG. 4A shows a first part S1 of the glue spreading unit S which is fixed to a structure of the machine N and a second part S2 of the glue spreading unit S that is interchangeable. The first part S1 of the glue spreading unit S applied to the structure of the machine N includes a table or support hinged to the structure of the machine N in such a way as to rotate from an operating position beside the new machine N as shown in FIG. 4B to a maintenance position shown in FIG. 4C in which the table or support is facing away from the bookbinding machine N.

A mechanical coupling S12 for the transmission of motion is provided on the structure of the bookbinding machine N and on the rotary table or support of the first part S1. When the rotary table or support of the first part S1 is placed in the operating position beside the structure of the machine N, the mechanical coupling S12 for the transmission of motion provides for transmitting motion to the components of the glue spreading unit S.

Other connections S3 without a transmission of motion provide for centering the table or support of the first part S1 in the correct position on the bookbinding machine N.

The interchangeable second part S2 of the glue spreading unit S substantially includes a tank S21 provided with rollers S22 and blades S23. The rollers S22 partially protrude from an upper edge of the tank S21, since they take glue present inside the tank S21 with their lower side and spread it on sheets with their upper side. The blades S23 provide for adjusting a quantity of glue that the rollers S22 deposit on the sheets.

The second interchangeable part S2 is connected to the first rotary part S1 through the use of either hooks or joints Sa that ensure its correct position and of mechanical couplings Sb that transmit motion from the bookbinding machine N to the rollers S22.

What is claimed is:

1. An automatic machine for the continuous binding of books and booklets, comprising:

a sheet levelling device;

trimming millers;

a glue spreading unit having rollers and blades;

a chain;

clamps mounted on said chain for transporting groups of sheets to be bound along various stations, said clamps having walls; and mechanisms controlling opening and closing of said clamps in various sections of a binding process;

each of said clamps having a manual opening mechanism independent of said mechanisms controlling the opening and closing of said clamps, said manual opening mechanism allowing said clamps to be opened at any given moment by releasing one of said walls from said mechanisms controlling the opening and closing of said clamps.

2. The automatic machine for the continuous binding of books and booklets according to claim 1, wherein said clamps are pneumatic clamps.

3. The automatic machine for the continuous binding of books and booklets according to claim 1, wherein said manual opening mechanism includes an elastic element and an operating lever.

4. The automatic machine for the continuous binding of books and booklets according to claim 3, wherein said elastic element is constructed to keep two parts of a respective one of said clamps in a position controlled by a respective one said mechanisms controlling opening and closing of said clamps.

5. The automatic machine for the continuous binding of books and booklets according to claim 4, wherein said lever counteracts an action of said elastic element and releases one of said walls of said mechanisms controlling opening and closing of said clamps.

6. An automatic machine for the continuous binding of books and booklets, comprising:

a sheet levelling device, including:

a horizontal levelling table having vibrators;

lower and upper parallel horizontal plates, said lower plate being permanently fixed to the machine, said upper plate supporting said horizontal levelling table; and connecting elements joining said plates, one of said connecting elements having a hole formed therein and an eccentric screw in said hole, said screw being rotatable for varying an inclination of said one connecting element, a vertical distance between said parallel horizontal plates and a height of said horizontal levelling table;

trimming millers;

a glue spreading unit having rollers and blades;

a chain;

clamps mounted on said chain for transporting groups of sheets to be bound along various stations; and mechanisms controlling opening and closing of said clamps in various sections of a binding process;

each of said clamps having a manual opening mechanism independent of said mechanisms controlling the opening and closing of said clamps.

7. An automatic machine for the continuous binding of books and booklets, comprising:

a sheet levelling device;

trimming millers;

a glue spreading unit having rollers and blades, said glue spreading unit including:

first and second complementary parts, said first part laterally rotating and hinged to a structure of the machine, said second part being interchangeable and supported by said first part; and a glue tank, glue rollers and glue blades supported by said second interchangeable part;

said first part having mechanical couplings for receiving motion from the bookbinding machines;

a chain;

clamps mounted on said chain for transporting groups of sheets to be bound along various stations; and mechanisms controlling opening and closing of said clamps in various sections of a binding process;

each of said clamps having a manual opening mechanism independent of said mechanisms controlling the opening and closing of said clamps.

8. An automatic machine for the continuous binding of books and booklets, comprising:

a sheet levelling device;

trimming millers;

a glue spreading unit having rollers and blades, said glue spreading unit including:

first and second complementary parts, said first part laterally rotating and hinged to a structure of the machine, said second part being interchangeable and supported by said first part; and a glue tank, glue rollers and glue blades supported by said second interchangeable part;

said first part having mechanical couplings for transmitting motion to said second interchangeable part to cause rotation of said glue rollers;

a chain;

clamps mounted on said chain for transporting groups of sheets to be bound along various stations; and mechanisms controlling opening and closing of said clamps in various sections of a binding process;

each of said clamps having a manual opening mechanism independent of said mechanisms controlling the opening and closing of said clamps.

* * * * *